US008202372B2

(12) United States Patent
Warkotsch et al.

(10) Patent No.: US 8,202,372 B2
(45) Date of Patent: Jun. 19, 2012

(54) PRODUCT FOR TREATING HARD SURFACES

(75) Inventors: Nadine Warkotsch, Duesseldorf (DE); Birgit Middelhauve, Monheim (DE); Marc-Steffen Schiedel, Duesseldorf (DE); Matthias Lueken, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 193 days.

(21) Appl. No.: 12/572,609

(22) Filed: Oct. 2, 2009

(65) Prior Publication Data

US 2010/0022427 A1 Jan. 28, 2010

Related U.S. Application Data

(63) Continuation of application No. PCT/EP2008/053996, filed on Apr. 3, 2008.

(30) Foreign Application Priority Data

Apr. 3, 2007 (DE) ..... 10 2007 016 389
May 21, 2007 (DE) ..... 10 2007 023 871
Aug. 14, 2007 (DE) ..... 10 2007 038 452

(51) Int. Cl.
*B08B 3/04* (2006.01)
*C11D 1/00* (2006.01)
*C11D 3/37* (2006.01)

(52) U.S. Cl. ..... 134/25.2; 134/25.3; 134/39; 134/42; 510/434; 510/466; 510/475; 510/488; 510/500; 510/501

(58) Field of Classification Search ..... 510/434, 510/466, 475, 488, 500, 501; 134/25.2, 25.3, 134/39, 42
See application file for complete search history.

(56) References Cited

U.S. PATENT DOCUMENTS

| | | | | |
|---|---|---|---|---|
| 3,367,920 | A | 2/1968 | Wasserman et al. | |
| 3,893,929 | A | 7/1975 | Basadur | |
| 4,000,093 | A | 12/1976 | Nicol et al. | |
| 4,116,885 | A | 9/1978 | Derstadt et al. | |
| 4,136,038 | A | 1/1979 | Pracht et al. | |
| 4,174,305 | A | 11/1979 | Burns et al. | |
| 4,201,824 | A | 5/1980 | Lagasse et al. | |
| 4,664,839 | A | 5/1987 | Rieck | |
| 5,534,182 | A | 7/1996 | Thomas et al. | |
| 5,622,926 | A | 4/1997 | Schade et al. | |
| 5,643,581 | A | 7/1997 | Mougin | |
| 6,395,265 | B1 | 5/2002 | Mougin | |
| 2003/0158064 | A1 | 8/2003 | Kessler et al. | |
| 2003/0198819 | A1 * | 10/2003 | Reusmann et al. | 428/447 |
| 2004/0034911 | A1 | 2/2004 | Day | |
| 2007/0092656 | A1 | 4/2007 | Keul | |
| 2008/0075683 | A1 | 3/2008 | Herzig | |
| 2009/0232752 | A1 | 9/2009 | Carson | |
| 2010/0011513 | A1 | 1/2010 | Warkotsch et al. | |
| 2010/0011519 | A1 | 1/2010 | Warkotsch et al. | |
| 2010/0016203 | A1 | 1/2010 | Warkotsch et al. | |
| 2010/0016206 | A1 | 1/2010 | Warkotsch et al. | |
| 2010/0022428 | A1 | 1/2010 | Warkotsch et al. | |
| 2010/0028270 | A1 | 2/2010 | Nguyen-Kim | |

FOREIGN PATENT DOCUMENTS

| | | | |
|---|---|---|---|
| DE | 1617141 | A1 | 10/1965 |
| DE | 2200911 | A1 | 1/1971 |
| DE | 2253063 | A1 | 10/1971 |
| DE | 2412837 | | 10/1974 |
| DE | 2655551 | A1 | 6/1977 |
| DE | 2846984 | A1 | 5/1979 |
| DE | 2857292 | A1 | 2/1980 |
| DE | 3324258 | A1 | 1/1984 |
| DE | 42 44 386 | A1 | 6/1994 |
| DE | 10037126 | A1 | 2/2002 |
| DE | 100 50 622 | A1 | 5/2002 |
| DE | 103 57 232 | B3 | 6/2005 |
| EP | 0164514 | A1 | 11/1984 |
| EP | 0 185 427 | | 6/1986 |
| EP | 0 213 739 | A2 | 3/1987 |
| EP | 0 300 305 | A2 | 7/1987 |
| EP | 0 241 984 | A2 | 10/1987 |
| EP | 0 241 985 | A2 | 10/1987 |
| EP | 0 213 729 | | 11/1987 |
| EP | 0 213 730 | | 11/1987 |
| EP | 2 53 567 | A1 | 1/1988 |
| EP | 0 271 312 | A2 | 6/1988 |
| EP | 2 72 033 | A2 | 6/1988 |
| EP | 0 274 907 | A1 | 7/1988 |
| EP | 357280 | A2 | 3/1990 |
| EP | 0 634 486 | A1 | 1/1995 |
| EP | 1 541 568 | A1 | 6/2005 |
| GB | 1154730 | | 6/1969 |
| GB | 1377092 | | 12/1974 |
| GB | 2007692 | A | 5/1979 |
| GB | 1578930 | | 11/1980 |
| GB | 2165856 | | 4/1986 |
| WO | WO-97/09369 | A | 3/1997 |
| WO | WO 99/41347 | | 8/1999 |
| WO | WO 00/77138 | A1 | 12/2000 |
| WO | WO-03/035712 | A1 | 5/2003 |
| WO | WO 03/042264 | A2 | 5/2003 |

(Continued)

OTHER PUBLICATIONS

International Search Report for Priority Application PCT/EP2008/054003, Jul. 2, 2008.

International Search Report of PCT/EP2008/053996, filed Apr. 3, 2008, mailed Jul. 8, 2008.

*Primary Examiner* — Brian P Mruk

(74) *Attorney, Agent, or Firm* — RatnerPrestia

(57) ABSTRACT

The invention relates to the use of polycarbonate-, polyurethane-, and/or polyurea-polyorganosiloxane compounds, or precursor compounds thereof containing specific reactive groups, in the treatment of hard surfaces. The treated surface is protected from soiling and/or the removal of soil from the surface is facilitated.

11 Claims, No Drawings

FOREIGN PATENT DOCUMENTS

| | | | |
|---|---|---|---|
| WO | WO 03/095530 | A1 | 11/2003 |
| WO | WO 2005/042684 | A1 | 5/2005 |
| WO | WO 2005/058863 | A1 | 6/2005 |
| WO | WO 2006/005358 | A1 | 1/2006 |
| WO | WO 2006/029794 | A1 | 3/2006 |
| WO | WO 2006/069742 | A1 | 7/2006 |
| WO | WO 2006/127882 | A2 | 11/2006 |

* cited by examiner

PRODUCT FOR TREATING HARD SURFACES

CROSS-REFERENCE TO RELATED APPLICATIONS

This application is a continuation under 35 U.S.C. §§120 and 365(c) of International Application PCT/EP2008/053996, filed on Apr. 3, 2008, and published as WO 2008/119833 on Oct. 9, 2008. This application also claims priority under 35 U.S.C. §119 from DE 10 2007016389.6 filed on Apr. 3, 2007, DE 10 2007023871.3, filed May 21, 2007 and DE 10 2007038452.3, filed Aug. 14, 2007. The disclosures of PCT/EP2008/053996, DE 10 2007016389.6, DE 10 2007023871.3, and DE 10 2007038452.3 are incorporated herein by reference in their entirety for all purposes.

FIELD OF THE INVENTION

The present invention relates to the field of treatment agents for hard surfaces, in particular cleaning agents for hard surfaces and agents which protect surfaces from soiling and/or facilitate the detachment of soiling from the surface.

DISCUSSION OF THE RELATED ART

In both the household and commercial fields, there are many different types of hard surfaces which are exposed to the effects of the most varied kinds of dirt. The surfaces of wall and floor tiles, glazing, kitchen appliances and ceramic sanitary ware may be mentioned purely by way of example. Agents containing surfactants have long been used for cleaning such surfaces, the cleaning action of which agents is primarily determined by the ability of surfactants to solubilize dirt particles, so making it possible to detach them or rinse them off from the surface. However, depending on the nature of the surface and nature of the dirt, the dirt can adhere remarkably strongly to the surface. This is all the more the case if the soiling remains for an extended period of time on the surface and the adhesion is so further strengthened by ageing processes. As a result, the dirt may become very difficult to remove and thus cause major difficulty with cleaning. The search has therefore intensified in recent times for agents which not only improve the cleaning power of cleaning agents but which prevent or at least delay the soiling of surfaces which are already in use.

Methods have accordingly been developed for various hard materials by means of which these materials may be provided with a dirt-repellent finish during their production. However, such permanent finishes can only be produced by complicated methods and are generally only available for new materials which are finished in this way by the original manufacturer.

In addition, however, agents have also been found with which surfaces may subsequently be finished in a manner which can be carried out domestically such that, at least for a certain service life, they are less easily soiled or may be cleaned more easily.

Facilitating and improving cleaning and preventing renewed soiling are of particular practical interest in the area of ceramic sanitary ware. Cleaning flush toilets above all involves removing lime and urine scale and fecal residues adhering to the ceramics. Conventional WC cleaning agents are frequently made acidic, for example by addition of organic acids such as citric acid or sulfamic acid, to ensure a high level of effectiveness against lime and urine scale. Cleaning performance against fecal soiling is generally also good, but mechanical force must be applied, thus with the assistance of a toilet brush, to the surface of the WC. This mechanical effort is greater in the case of older, already dried on soiling, with even moist fecal soiling being capable of adhering tenaciously to ceramic materials.

Patent application WO 2006/005358 discloses copolymers which consist of at least one of each of an anionic vinyl monomer, a vinyl monomer with a quaternary ammonium group or a tertiary amino group, and a nonionic hydrophilic vinyl monomer or a polyfunctional vinyl monomer. These copolymers are suitable as soil-inhibiting components in cleaning agents and are effective, for example, against fecal soiling.

However, even using these cleaners, longer lasting cleanness, which possibly extends beyond one-off use, of the toilet interior relative to renewed fecal soiling cannot be achieved in completely satisfactory manner.

A further problem may also arise from the fact that, to enhance dissolution of lime, toilet cleaning agents are not uncommonly left to act on the ceramics for an extended period of time, often for several hours or even overnight. In order to promote adhesion to the ceramics, the formulations are generally thickened. In the event of an extended period of action, a film then forms on the surface which, due to the product color, is usually colored and, once having dried on, can only be removed with difficulty.

Hard surfaces which are repeatedly exposed to the action of moisture are frequently colonized by microorganisms resulting in the formation of biofilms. Biofilms consist of a thin mucilaginous layer (film) in which microorganisms (for example bacteria, algae, fungi, protozoa) are embedded. This may constitute a problem of not only a hygienic but also an esthetic nature. Bactericidal substances are frequently used as countermeasures. However, this is not always without its own problems due to the ecotoxicological properties of many of these substances and the associated restrictions on their use. Moreover, biofilms contribute to the formation of unpleasant smelling substances and are therefore a source of unwanted malodors, in particular in sanitary applications.

Agents for treating hard surfaces must furthermore satisfy other requirements. For instance, it is important for the appearance of the surface not to be impaired after it has been treated. Factors which are in particular of importance here are the retention of gloss on surfaces which in the original or clean state are glossy and the avoidance of residues of the treatment agent, for example in the form of lines or streaks.

Finally there was a requirement for methods and agents for providing a hard surface with a dirt-repellent finish and/or for facilitating the detachment of dirt, it optionally being possible to achieve these actions in an independent surface treatment method, or alternatively in the course of a conventionally occurring cleaning method.

BRIEF SUMMARY OF THE INVENTION

The object of the present invention was accordingly to remedy at least in part the above-stated disadvantages of the prior art. In particular, the object was to improve the removability of fecal soiling and biofilms from hard surfaces, in particular WC ceramics, and to prevent such soiling from reforming on such surfaces.

It has now been found that not only specific polycarbonate-, polyurethane- and/or polyurea-polyorganosiloxane compounds, but also the precursor compounds of the reactive cyclic carbonate and urea type usable in the production thereof, are particularly suitable for protecting a surface treated therewith from soiling and/or for facilitating detachment of soiling from the surface.

DETAILED DESCRIPTION OF CERTAIN EMBODIMENTS OF THE INVENTION

The present invention accordingly provides the use of one or more polycarbonate-, polyurethane- and/or polyurea-polyorganosiloxane compounds containing at least one structural element of Formula (I):

$$-Y-A-(C{=}O)-A- \quad (I),$$

each A being independently selected from S, O and $NR^1$,

Y being selected from di- to polyvalent, in particular tetravalent, straight-chain, cyclic or branched, saturated, unsaturated or aromatic, substituted or unsubstituted hydrocarbon residues with up to 1000 carbon atoms (the carbon atoms of an optionally present polyorganosiloxane unit not being included in said number), which may contain one or more groups selected from —O—, —(CO)—, —NH—, —$NR^2$—, —($N^+R^2R^3$)— and a polyorganosiloxane unit with 2 to 1000 silicon atoms, $R^1$ being hydrogen or a straight-chain, cyclic or branched, saturated, unsaturated or aromatic hydrocarbon residue with up to 40 carbon atoms, which may contain one or more groups selected from —O—, —(CO)—, —NH— and —$NR^2$—, $R^2$ being a straight-chain, cyclic or branched, saturated, unsaturated or aromatic hydrocarbon residue with up to 40 carbon atoms, which may contain one or more groups selected from —O—, —(CO)— and —NH—, $R^3$ being a straight-chain, cyclic or branched, saturated, unsaturated or aromatic hydrocarbon residue with up to 100 carbon atoms, which may contain one or more groups selected from —O—, —(CO)— and —NH—, or being a divalent residue which forms cyclic structures within the residue Y, or one or both of the residues A adjacent to Y possibly forming a nitrogenous heterocyclic residue with the residue Y located between them, and in the entire compound all the residues A or Y or $R^1$ or $R^2$ or $R^3$ stated in formula (I) not necessarily being identical, providing that, in the entire compound, at least one of the residues Y comprises a polyorganosiloxane unit with 2 to 1000 silicon atoms, or the acid addition compounds and/or salts thereof for treating a hard surface, the treated surface being protected from soiling and/or the detachment of soiling from the surface being facilitated, and/or for improving the cleaning performance of a cleaning agent for a hard surface.

For the purposes of the present invention, hard surfaces for example comprise surfaces of stone or ceramic materials, rigid plastics materials, glass or metal. Hard surfaces may be, for example, walls, work surfaces, flooring or sanitary articles. In particular, the invention relates to surfaces of ceramics, preferably ceramic sanitary ware, and very particularly of toilet bowls.

For the purposes of the invention, soiling should in particular be taken to mean fecal soiling and/or biofilms.

Use of the substances used according to the invention in particular improves the cleaning performance of cleaning agents for hard surfaces and ensures that surfaces treated or cleaned therewith are perceived to be clean for longer.

In particular when the substances used according to the invention are used as a constituent of cleaning agents, they can bring about an improvement in cleaning performance which is manifested both as easier removability of soiling and as reduced susceptibility to resoiling.

It has been observed that not only easier and more rapid removal of fecal soiling but also improved rinsing away of the dried on (colored) cleaning agent itself is possible if one of the substances used according to the invention is added to the cleaning agent formulation. As a working hypothesis, it is suspected that, on application, cleaning agents which contain such substances form a durable, thin film on ceramic surfaces, which film may be swollen by water on flushing. If fecal soiling occurs on the film, the dirt can be removed without appreciable mechanical force the next time the toilet is flushed. In general, this is achieved solely by the mechanical action of the flushing water, without requiring any additional assistance from a toilet brush. If colored cleaning formulations are left to act on the surface for an extended period and the formulation dries on to some extent, the resultant colored film is nevertheless easily and completely removed the next time the toilet is flushed.

Compounds of Formula (I) may be obtained by reacting diisocyanates, bis-chloroformic acid esters or amides or phosgene with thiols, alcohols or amines containing the structural element Y. In order to obtain polymeric structures, these starting compounds comprising the structural element Y comprise at least 2 of the stated functional groups. Compounds which may be considered as end groups are those which otherwise correspond to the structural element Y, but are only monofunctional.

Preferred polycarbonate- and/or polyurethane-polyorganosiloxane-compounds are those which contain at least one structural element of Formula (II) or (III):

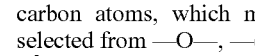

$$-A-Y-A-(CO)-O-Z-(CHOH)-Z-O-(CO)- \quad (II),$$

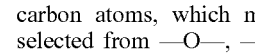

$$-A-Y-A-(CO)-O-(CHCH_2OH)-Z-O-(CO)- \quad (III),$$

in which A and Y have the above-stated meanings and

Z is selected from divalent, straight-chain, cyclic or branched, saturated or unsaturated, optionally substituted hydrocarbon residues with 1 to 12 carbon atoms. These structural elements may be obtained by ring opening of cyclic carbonates (carbonic acid esters of vicinal diols) with thiols, alcohols or amines containing the structural element Y.

The polycarbonate-, polyurethane- and/or polyurea-polyorganosiloxane compound preferably comprises the structural element of Formula (I) twice or more in succession, it being possible for the repeatedly occurring mutually corresponding residues A or Y or Z or $R^1$ or $R^2$ or $R^3$ to be identical or different.

The term acid addition compound means a salt-like compound which may be obtained by protonation of basic groups in the molecule, such as in particular the optionally present amino groups, for example by reaction with inorganic or organic acids. The acid addition compounds may be used as such or, under conditions of use, may optionally form the above defined compounds.

If the polycarbonate-, polyurethane- and/or polyurea-polyorganosiloxane compound contains groupings —($N^+R^2R^3$)—, conventional counteranions, such as for example halide, hydroxide, sulfate, carbonate, are present in a quantity ensuring charge neutrality.

The polyorganosiloxane structural element present in the polycarbonate-, polyurethane- and/or polyurea-polyorganosiloxane compounds is preferably the structure —$(SiR^4{}_2O)_p$—$(SiR^4{}_2)$—, in which $R^4$ is a straight-chain, cyclic or branched, saturated, unsaturated or aromatic hydrocarbon residue with up to 20 carbon atoms and p=1 to 999. The polycarbonate-, polyurethane- and/or polyurea-polyorganosiloxane compounds preferably contain on average at least two, in particular at least three, of the stated polyorganosiloxane structural elements. $R^4$ is preferably a straight-chain or cyclic or branched, saturated or unsaturated or aromatic $C_1$ to $C_{20}$, in particular $C_1$ to $C_9$ hydrocarbon residue, particularly preferably methyl or phenyl, and p is in particular 1 to 199, particularly preferably 1 to 99. In a preferred embodiment, all the residues $R^4$ are identical.

Polycarbonate-, polyurethane- and/or polyurea-polyorganosiloxane compounds which are preferably used according to the invention are linear, i.e. all the Y units in the structural element of the formula (I) are in each case divalent residues. Branched compounds in which at least one of the residues Y is tri- or polyvalent, preferably tetravalent, such that branched structures with linear repeat structures are formed from structural elements of Formula (I) are, however, also included according to the invention.

In a further embodiment, in the polycarbonate-, polyurethane- and/or polyurea-polyorganosiloxane compound used according to the invention, at least one of the Y units according to the structural element of Formula (I) comprises a grouping —$NR^2$— and/or at least one of the Y units according to the structural element of the formula (I) comprises a grouping —($N^+R^2R^3$)—. $R^2$ and $R^3$ are here preferably methyl groups.

A further embodiment relates to the repeated, regular occurrence of —O-groupings in at least one of the units Y, $R^1$, $R^2$ and/or $R^3$ according to the structural element of Formula (I), preferably in the form of oligoethoxy and/or oligopropoxy groups, the degrees of oligomerization thereof preferably being in the range from 2 to 60.

In a further preferred embodiment, oligoethyleneimine groups are present in at least one of the units Y, $R^1$, $R^2$ and/or $R^3$ according to the structural element of the formula (I), the degrees of oligomerization of which groups are in particular in the range from 10 to 150,000.

Reactive cyclic carbonates and ureas, methods for the production thereof and the reaction thereof with polymeric substrates are described in international patent application WO 2005/058863. It has surprisingly now been found that not only polycarbonate- and/or polyurethane-polyorganosiloxane compounds of the above-stated kind obtainable therefrom improve the tenacity of fragrances on surfaces, but the reactive cyclic carbonates and ureas themselves or polymers obtainable therefrom by reaction with polymeric substrates also exhibit the desired effect.

The present invention accordingly also provides the use of compounds of the general Formula IV or Formula V,

IV

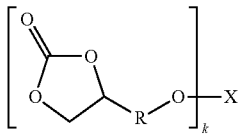

V

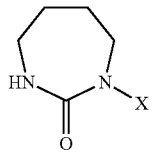

in which

R denotes $C_1$-$C_{12}$ alkylene;

k denotes a number greater than 0,

X denotes CO—CH═$CH_2$, CO—C($CH_3$)═$CH_2$, CO—O-aryl, $C_2$-$C_6$-alkylene-$SO_2$—CH═$CH_2$, or CO—NH—$R^1$; and $R^1$ denotes $C_1$-$C_{30}$ alkyl, $C_1$-$C_{30}$ haloalkyl, $C_1$-$C_{30}$ hydroxyalkyl, $C_1$-$C_6$-alkyloxy-$C_1$-$C_{30}$-alkyl, $C_1$-$C_6$-alkylcarbonyl-oxy-$C_1$-$C_{30}$-alkyl, amino-$C_1$-$C_{30}$-alkyl, mono- or di($C_1$-$C_6$-alkyl)amino-$C_1$-$C_{30}$-alkyl, ammonio-$C_1$-$C_{30}$-alkyl, polyoxyalkylene-$C_1$-$C_{30}$-alkyl, polysiloxanyl-$C_1$-$C_{30}$-alkyl, (meth)acryloyloxy-$C_1$-$C_{30}$-alkyl, sulfono-$C_1$-$C_{30}$-alkyl, phosphono-$C_1$-$C_{30}$-alkyl, di($C_1$-$C_6$-alkyl)phosphono-$C_1$-$C_{30}$-alkyl, phosphonato-$C_1$-$C_{30}$-alkyl, di($C_1$-$C_6$-alkyl)phosphonato-$C_1$-$C_{30}$-alkyl or a saccharide residue, X having this meaning in Formula (IV) only when k denotes 1, or, X denotes (i) the residue of a polyamine, onto which the portion of the formula located between parentheses is attached via (CO)NH groups, or (ii) a polymeric skeleton, onto which the portion of the formula located between parentheses is attached via (CO), NH—$C_2$-$C_6$-alkylene-O(CO) or (CO)—O—$C_2$-$C_6$-alkylene-O(CO) groups, or (iii) a polymeric skeleton, onto which the portion of the formula located between parentheses is attached via (CO)-polysiloxanyl-$C_1$-$C_{30}$-alkyl groups, if k denotes a number of greater than 1, and/or of polymers which are obtainable by reacting a polymeric substrate, which has functional groups which are selected from hydroxy groups, primary and secondary amino groups, with a compound of the general Formula (IV) or (V), for treating a hard surface, the treated surface being protected from soiling and/or the detachment of soiling from the surface being facilitated, and/or for improving the cleaning performance of a cleaning agent for a hard surface.

Polymeric substrates which are suitable in connection with the latter-stated aspect of the invention include in particular polyvinyl alcohols, polyalkyleneamines such as polyethyleneimines, polyvinylamines, polyallylamines, polyethylene glycols, chitosan, polyamide-epichlorohydrin resins, polyaminostyrenes, polysiloxanes substituted terminally or as a side group with aminoalkyl groups such as polydimethylsiloxanes, peptides, polypeptides, and proteins and mixtures thereof. Particularly preferred polymeric substrates are selected from polyethyleneimines with molar weights in the range from 5000 to 100,000, in particular 15,000 to 50,000, compounds of the formula $NH_2$—$[CH_2]_m$—$(Si(CH_3)_2O)_n$—$Si(CH_3)_2$-$[CH_2]_o$—R', m being 1 to 10, preferably 1 to 5, particularly preferably 1 to 3, n being 1 to 50, preferably 30 to 50, o being 0 to 10, preferably 1 to 5, particularly preferably 1 to 3 and R' being H, $C_{1-22}$ alkyl, an amino or ammonium group, and/or compounds of the formula $NH_2$—$[CH(CH_3)$—$CH_2O]_l$—$[CH_2$—$CH_2O]_m$—$[CH_2$—$CH(CH_3)O]_n$—R", l, m and n mutually independently being numbers from 0 to 50, providing that the total l+m+n is 5 to 100, in particular 10 to 50, preferably 10 to 30, particularly preferably 10 to 20, and R" being H, a $C_{1-22}$ alkyl, $C_{1-22}$ aminoalkyl or $C_{1-22}$ ammoniumalkyl group, and mixtures thereof.

Preferred polymers are those which are obtainable by reacting the polymeric substrate with a compound of the general Formula (IV) with k=1 or (V). Preferred polymers are furthermore those which are obtainable by reacting the polymeric substrate with, relative to its content of hydroxy groups, primary and secondary amino groups, identical molar quantities of compound of the general Formula (IV) with k=1 or (V).

The compound of Formula (IV) is preferably selected from 4-phenyloxycarbonyloxymethyl-2-oxo-1,3-dioxolane, 4-(4-phenyloxycarbonyloxy)butyl-2-oxo-1,3-dioxolane, 2-oxo-1,3-dioxolan-4-yl-methyl acrylate, 2-oxo-1,3-dioxolan-4-yl-methyl methacrylate, 4-(2-oxo-1,3-dioxolan-4-yl)-butyl acrylate,
4-(2-oxo-1,3-dioxolan-4-yl)-butyl methacrylate and
4-(vinylsulfonylethyloxy)-butyl-2-oxo-1,3-dioxolane.

Use according to the invention may proceed in the context of a method for treating a hard surface in such a manner that one or more of the active ingredients used according to the invention (the polycarbonate-, polyurethane- and/or polyurea-polyorganosiloxane compound, the reactive cyclic carbonate or the reactive cyclic urea or the polymer obtainable from the latter by reaction with a polymeric substrate), is brought into contact with the surface, in particular in the presence of a surfactant.

The present invention accordingly likewise provides a method for treating a hard surface, in which the surface is brought into contact with one or more of the stated active ingredients and a surfactant.

This method may be carried out as an independent treatment method for the surface, in particular to provide it with dirt-repellent characteristics. The surface is here treated with a preferably aqueous agent which, apart from at least one of the above-described substances used according to the invention, additionally contains at least one surfactant. The surfactant is here selected such that it cannot interact undesirably with the substances used according to the invention.

The method according to the invention is preferably carried out such that one or more of the stated active ingredients and the surfactant are spread extensively over the surface and either rinsed off after a period of action of 1 to 10 minutes or alternatively left to dry.

In a preferred embodiment of the method, contacting proceeds at a temperature of 5 to 50° C., in particular of 15 to 35° C.

In a particularly preferred embodiment, the method according to the invention is a cleaning method which serves for surface cleaning.

In a particularly preferred embodiment of the method according to the invention, the active ingredients used according to the invention are brought into contact with the surface as constituent(s) of an aqueous surfactant-containing cleaning agent.

The present invention also provides an agent for treating a hard surface, containing (a) one or more of the stated active ingredients,
(b) at least one surfactant and
(c) optionally water and/or further conventional constituents, compatible with the other ingredients, of surface treatment or cleaning agents.

The one or plurality of stated active ingredients are preferably present in the agent in quantities of 0.01 to 50 wt. %, preferably of 0.2 to 15 wt. %, and in particular of 0.5 to 5 wt. %, in each case relative to the total weight of the agent.

In one particular embodiment of the invention, the agents may contain at least one ingredient selected from the group comprising acids, thickeners and nonaqueous solvents.

The agent according to the invention is preferably a cleaning agent, in particular a cleaning agent for ceramics, particularly preferably for ceramic sanitary ware.

Another embodiment of the invention accordingly relates to the use of agents, in particular cleaning agents, which contain one or more of the stated active ingredients, for treating hard surfaces, in particular of ceramic sanitary ware, for the purpose of improving the removability of fecal soiling and/or biofilms in flush toilets, for preventing such soiling from reforming, and for improving the rinsability of dried-on cleaning agent residues on hard surfaces, in particular of ceramic sanitary ware.

Such agents may be used in a method for cleaning WC surfaces in which in particular fecal soiling and/or biofilms may more easily be removed. Another embodiment of the invention accordingly relates to a method for improving the removability of fecal soiling and/or of biofilms in flush toilets, in which an agent according to the invention, in particular a cleaning agent according to the invention, is spread extensively over the surface and is either rinsed off after a period of action of for example 1 to 10 minutes or alternatively left to dry.

The agents according to the invention may furthermore contain other conventional constituents of agents, in particular cleaning agents, for treating hard surfaces, provided that these do not interact in undesired manner with the substances used according to the invention.

Apart from acids, thickeners and nonaqueous solvents, such other constituents which may be considered are for example film formers, antimicrobial active ingredients, builders, corrosion inhibitors, complexing agents, alkalis, preservatives, bleaching agents, enzymes as well as fragrances and dyes. Overall, the agents should preferably contain no more than 30 wt. %, preferably 0.01 to 30 wt. %, in particular 0.2 to 15 wt. % of further ingredients.

The agents according to the invention contain at least one surfactant which is selected from anionic, nonionic, amphoteric and cationic surfactants and mixtures thereof.

Suitable anionic surfactants are preferably $C_8$-$C_{18}$ alkylbenzene sulfonates, in particular with around 12 C atoms in the alkyl moiety, $C_8$-$C_{20}$ alkane sulfonates, $C_8$-$C_{18}$ monoalkyl sulfates, $C_8$-$C_{18}$ alkyl polyglycol ether sulfates with 2 to 6 ethylene oxide units (EO) in the ether moiety and sulfosuccinic acid mono- and di-$C_8$-$C_{18}$-alkyl esters. It is furthermore also possible to use $C_8$-$C_{18}$ α-olefin sulfonates, sulfonated $C_8$-$C_{18}$ fatty acids, in particular dodecylbenzenesulfonate, $C_8$-$C_{22}$ carboxylic acid amide ether sulfates, $C_8$-$C_{18}$ alkyl polyglycol ether carboxylates, $C_8$-$C_{18}$ N-acyl taurides, $C_8$-$C_{18}$ N-sarcosinates and $C_8$-$C_{18}$ alkyl isethionates or mixtures thereof. The anionic surfactants are preferably used as sodium salts, but may also be present as other alkali or alkaline earth metal salts, for example magnesium salts, and in the form of ammonium or mono-, di-, tri- or tetraalkylammonium salts, in the case of sulfonates, also in the form of their corresponding acid, for example dodecylbenzenesulfonic acid. Examples of such surfactants are sodium cocoalkyl sulfate, sodium sec.-alkanesulfonate with approx. 15 C atoms and sodium dioctylsulfosuccinate. Sodium fatty alkyl sulfates and fatty alkyl+2EO ether sulfates with 12 to 14 C atoms have proved particularly suitable.

Nonionic surfactants which may primarily be mentioned are $C_8$-$C_{18}$ alcohol polyglycol ethers, i.e. ethoxylated and/or propoxylated alcohols with 8 to 18 C atoms in the alkyl moiety and 2 to 15 ethylene oxide (EO) and/or propylene oxide (PO) units, $C_8$-$C_{18}$ carboxylic acid polyglycol esters with 2 to 15 EO, for example tallow fatty acid+6 EO esters, ethoxylated fatty acid amides with 12 to 18 C atoms in the fatty acid moiety and 2 to 8 EO, long-chain amine oxides with 14 to 20 C atoms and long-chain alkyl polyglycosides with 8 to 14 C atoms in the alkyl moiety and 1 to 3 glycoside units. Examples of such surfactants are oleyl-cetyl alcohol with 5 EO, nonylphenol with 10 EO, lauric acid diethanolamide, cocoalkyl dimethylamine oxide and cocoalkyl polyglucoside with on average 1.4 glucose units. $C_{8-18}$ fatty alcohol polyglycol ethers with in particular 2 to 8 EO, for example $C_{12}$ fatty alcohol+7-EO ether, and $C_{8-10}$ alkyl polyglucosides with 1 to 2 glycoside units are particularly preferably used.

Suitable amphoteric surfactants are for example betaines of the formula $(R^{iii})(R^{iv})(R^{v})N^{+}CH_2COO^{-}$, in which $R^{iii}$ means an alkyl residue with 8 to 25, preferably 10 to 21 carbon atoms optionally interrupted by heteroatoms or groups of heteroatoms and $R^{iv}$ and $R^{v}$ mean identical or different alkyl residues with 1 to 3 carbon atoms, in particular $C_{10}$-$C_{18}$ alkyl dimethyl carboxymethyl betaine and $C_{11}$-$C_{17}$ alkylamidopropyl dimethyl carboxymethyl betaine.

Suitable cationic surfactants are inter alia the quaternary ammonium compounds of the formula $(R^{vi})(R^{vii})(R^{viii})(R^{ix})N^{+}X^{-}$, in which $R^{vi}$ to $R^{ix}$ denote four identical or different, in particular two long-chain and two short-chain, alkyl residues and $X^{-}$ denotes an anion, in particular a halide ion, for example didecyldimethylammonium chloride, alkylbenzyldidecylammonium chloride and mixtures thereof.

In a preferred embodiment, however, the only surfactant components the agent contains are one or more anionic surfactants, preferably $C_8$-$C_{18}$ alkyl sulfates and/or $C_8$-$C_{18}$ alkyl ether sulfates, and/or one or more nonionic surfactants, preferably $C_{8-18}$ fatty alcohol polyglycol ethers with 2 to 8 EO and/or $C_{8-10}$ alkyl polyglucosides with 1 to 2 glycoside units.

The agents according to the invention contain surfactants preferably in quantities of 0.01 to 30 wt. %, in particular of 0.2 to 15 wt. %, in each case relative to the total weight of the agent.

Agents according to the invention may furthermore contain one or more acid(s). Suitable acids are in particular organic acids such as formic acid, acetic acid, citric acid, glycolic acid, lactic acid, succinic acid, adipic acid, malic acid, tartaric acid and gluconic acid or also amidosulfonic acid. The inorganic acids hydrochloric acid, sulfuric acid, phosphoric acid and nitric acid or mixtures thereof may, however, additionally be used. Particularly preferred acids are those selected from the group comprising amidosulfonic acid, citric acid, lactic acid and formic acid. They are preferably used in quantities of 0.01 to 30 wt. %, particularly preferably of 0.2 to 15 wt. %.

In a further embodiment, an agent according to the invention contains a thickener. Any viscosity regulators used in the prior art in laundry detergents and cleaning agents may in principle be considered for this purpose, such as for example organic natural thickeners (agar-agar, carrageenan, tragacanth, gum arabic, alginates, pectins, polyoses, guar flour, locust bean flour, starch, dextrins, gelatin, casein), modified organic natural substances (carboxymethylcellulose and other cellulose ethers, hydroxyethylcellulose and hydroxypropylcellulose and the like, seed flour ethers), completely synthetic organic thickeners (polyacrylic and polymethacrylic compounds, vinyl polymers, polycarboxylic acids, polyethers, polyimines, polyamides) and inorganic thickeners (polysilicic acids, clay minerals such as montmorillonites, zeolites, silicas). The polyacrylic and polymethacrylic compounds include, for example, the high molecular weight homopolymers, crosslinked with a polyalkenyl polyether, in particular an allyl ether of sucrose, pentaerythritol or propylene, of acrylic acid (INCl name according to International Dictionary of Cosmetic Ingredients of The Cosmetic, Toiletry, and Fragrance Association (CTFA): Carbomer), which are also known as carboxyvinyl polymers. Such polyacrylic acids are obtainable inter alia from 3V Sigma under the trade name Polygel®, for example Polygel® DA, and from B.F. Goodrich under the trade name Carbopol®, for example Carbopol® 940 (molecular weight approx. 4,000,000), Carbopol® 941 (molecular weight approx. 1,250,000) or Carbopol® 934 (molecular weight approx. 3,000,000). They furthermore include the following acrylic acid copolymers: (i) copolymers of two or more monomers from the group of acrylic acid, methacrylic acid and the simple esters thereof, preferably formed with $C_{1-4}$ alkanols (INCl Acrylates Copolymer), which include for instance the copolymers of methacrylic acid, butyl acrylate and methyl methacrylate (CAS name according to Chemical Abstracts Service: 25035-69-2) or of butyl acrylate and methyl methacrylate (CAS 25852-37-3) and which are obtainable for example from Rohm & Haas under the trade names Aculyn® and Acusol® and from Degussa (Goldschmidt) under the trade name Tego® Polymer, for example the anionic non-associative polymers Aculyn® 22, Aculyn® 28, Aculyn® 33 (crosslinked), Acusol® 810, Acusol® 823 and Acusol® 830 (CAS 25852-37-3); (ii) crosslinked high molecular weight acrylic acid copolymers, which include for instance the copolymers, crosslinked with an allyl ether of sucrose or of pentaerythritol, of $C_{10-30}$ alkyl acrylates with one or more monomers from the group of acrylic acid, methacrylic acid and the simple esters thereof, preferably formed with $C_{1-4}$ alkanols (INCl Acrylates/C10-30 Alkyl Acrylate Crosspolymer) and which are obtainable for example from B.F. Goodrich under the trade name Carbopol®, for example hydrophobized Carbopol® ETD 2623 and Carbopol® 1382 (INCl Acrylates/C10-30 Alkyl Acrylate Crosspolymer) and Carbopol® Aqua 30 (formerly Carbopol® EX 473). Further thickeners are polysaccharides and heteropolysaccharides, in particular polysaccharide gums, for example gum arabic, agar, alginates, carageenans and the salts thereof, guar, guaran, tragacanth, gellan, ramsan, dextran or xanthan and the derivatives thereof, for example propoxylated guar, and mixtures thereof. Other polysaccharide thickeners, such as starches or cellulose derivatives, may however alternatively preferably be used in addition to a polysaccharide gum, for example starches of the most varied origin and starch derivatives, for example hydroxyethyl starch, starch phosphate esters or starch acetates, or carboxymethylcellulose or the sodium salt thereof, methyl-, ethyl-, hydroxyethyl-, hydroxypropyl-, hydroxypropylmethyl- or hydroxyethylmethylcellulose or cellulose acetate. One particularly preferred polysaccharide thickener is the microbial anionic heteropolysaccharide xanthan gum, which is produced by *Xanthomonas campestris* and some other species under aerobic conditions, with a molecular weight of $2\text{-}15\times10^{6}$ and is obtainable for example from Kelco under the trade names Keltrol® and Kelzan® or also from Rhodia under the trade name Rhodopol®. Phyllosilicates may furthermore be used as thickeners. These include for example the magnesium or sodium/magnesium phyllosilicates obtainable under the trade name Laponite® from Solvay Alkali, in particular Laponite® RD or also Laponite® RDS, and the magnesium silicates from Süd-Chemie, especially Optigel® SH.

In a preferred embodiment, the agent according to the invention contains 0.01 to 30 wt. %, in particular 0.2 to 15 wt. % of a thickener, preferably a polysaccharide thickener, for example xanthan gum.

The agents according to the invention may contain solvents, in particular water and/or nonaqueous solvents, preferably water-soluble organic solvents. These include, for example, lower alcohols and/or ether alcohols, lower alcohols being taken for the purposes of the present invention to mean straight-chain or branched $C_{1-6}$ alcohols. The alcohols used are in particular ethanol, isopropanol and n-propanol. Ether alcohols which may be considered are adequately water-soluble compounds with up to 10 C atoms per molecule. Examples of such ether alcohols are ethylene glycol monobutyl ether, propylene glycol monobutyl ether, diethylene glycol monobutyl ether, propylene glycol mono-tert.-butyl ether and propylene glycol monoethyl ether, among which ethylene glycol monobutyl ether and propylene glycol monobutyl ether are in turn preferred. In a preferred embodiment, however, ethanol is used as the solvent. Solvents may be present in the cleaning agent in quantities of 0.01 to 30 wt. %, preferably of 0.2 to 15 wt. %.

The agents according to the invention may furthermore contain film formers which may assist in improving wetting of surfaces. Any film-forming polymers used in the prior art in laundry detergents and cleaning agents may in principle be considered for this purpose. Preferably, however, the film former is selected from the group comprising polyethylene glycol, polyethylene glycol derivatives and mixtures thereof, preferably with a molecular weight of between 200 and 20,000,000, particularly preferably of between 5,000 and 200,000. The film former is advantageously used in quantities of 0.01 to 30 wt. %, in particular of 0.2 to 15 wt. %.

Agents according to the invention may furthermore contain one or more antimicrobial active ingredients, preferably in a quantity of 0.01 to 1 wt. %, in particular of 0.05 to 0.5 wt. %, particularly preferably of 0.1 to 0.3 wt. %. Suitable antimicrobial active ingredients are for example those from the groups of alcohols, aldehydes, antimicrobial acids or the salts thereof, carboxylic acid esters, acid amides, phenols, phenol derivatives, diphenyls, diphenyl alkanes, urea derivatives, oxygen or nitrogen acetals and formals, benzamidines, isothiazoles and the derivatives thereof such as isothiazolines and isothiazolinones, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butylcarbamate, iodine, iodophores and peroxides. Preferred antimicrobial active ingredients are preferably selected from the group comprising ethanol, n-propanol, i-propanol, 1,3-butanediol, phenoxyethanol, 1,2-propylene glycol, glycerol, undecenoic acid, citric acid, lactic acid, benzoic acid, salicylic acid, thymol, 2-benzyl-4-chlorophenol, 2,2'-methylene-bis(6-bromo-4-chlorophenol), 2,4,4'-trichloro-2'-hydroxy-diphenyl ether, N-(4-chlorophenyl)-N-(3,4-dichlorophenyl)-urea, N,N'-(1,10-decanediyldi-1-pyridinyl-4-ylidene)-bis-(1-octanamine) dihydro-chloride, N,N'-bis(4-chlorophenyl)-3,12-diimino-2,4,11,13-tetraazatetradecane diimide amide, antimicrobial quaternary surface-active compounds, guanidines. Preferred antimicrobially active surface-active quaternary compounds contain an ammonium, sulfonium, phosphonium, iodonium or arsonium group. It is furthermore also possible to use antimicrobially active essential oils which simultaneously fragrance the cleaning agent. Particularly preferred antimicrobial active ingredients are, however, selected from the group comprising salicylic acid, quaternary surfactants, in particular benzalkonium chloride, peroxide compounds, in particular hydrogen peroxide, alkali metal hypochlorite and mixtures thereof.

Water-soluble and/or water-insoluble builders may be used in the agents according to the invention. Water-soluble builders are here preferred as they generally have a lesser tendency to leave insoluble residues behind on hard surfaces. Conventional builders which may be present for the purposes of the invention are low molecular weight polycarboxylic acids and the salts thereof, homopolymeric and copolymeric polycarboxylic acids and the salts thereof, citric acid and the salts thereof, carbonates, phosphates and silicates. Water-insoluble builders include zeolites, which may likewise be used, together with mixtures of the above-stated builder substances.

Suitable corrosion inhibitors are for example the following substances listed by their INCl names: Cyclohexylamine, Diammonium Phosphate, Dilithium Oxalate, Dimethylamino Methylpropanol, Dipotassium Oxalate, Dipotassium Phosphate, Disodium Phosphate, Disodium Pyrophosphate, Disodium Tetrapropenyl Succinate, Hexoxyethyl Diethylammonium, Phosphate, Nitromethane, Potassium Silicate, Sodium Aluminate, Sodium Hexametaphosphate, Sodium Metasilicate, Sodium Molybdate, Sodium Nitrite, Sodium Oxalate, Sodium Silicate, Stearamidopropyl Dimethicone, Tetrapotassium Pyrophosphate, Tetrasodium Pyrophosphate, Triisopropanolamine.

Complexing agents, which are also known as sequestrants, are ingredients which are capable of complexing and inactivating metal ions in order to prevent their disadvantageous effects on the stability or appearance, for example cloudiness, of the agents. On the one hand, it is important to complex the calcium and magnesium ions of water hardness which are incompatible with numerous ingredients. On the other hand, complexation of heavy metal ions such as iron or copper delays oxidative decomposition of the finished agents. Complexing agents additionally support the cleaning action. The following complexing agents, listed by their INCl names, are for example suitable: Aminotrimethylene, Phosphonsäure, Beta-Alanine Diacetic Acid, Calcium Disodium EDTA, Citric Acid, Cyclodextrin, Cyclohexanediamine Tetraacetic Acid, Diammonium Citrate, Diammonium EDTA, Diethylenetriamine Pentamethylene Phosphonic Acid, Dipotassium EDTA, Disodium Azacycloheptane Diphosphonate, Disodium EDTA, Disodium Pyrophosphate, EDTA, Etidronic Acid, Galactaric Acid, Gluconic Acid, Glucuronic Acid, HEDTA, Hydroxypropyl Cyclodextrin, Methyl Cyclodextrin, Pentapotassium Triphosphate, Pentasodium Aminotrimethylene Phosphonate, Pentasodium Ethylenediamine Tetramethylene Phosphonate, Pentasodium Pentetate, Pentasodium Triphosphate, Pentetic Acid, Phytic Acid, Potassium Citrate, Potassium EDTMP, Potassium Gluconate, Potassium Polyphosphate, Potassium Trisphosphonomethylamine Oxide, Ribonic Acid, Sodium Chitosan Methylene Phosphonate, Sodium Citrate, Sodium Diethylenetriamine Pentamethylene Phosphonate, Sodium Dihydroxyethylglycinate, Sodium EDTMP, Sodium Gluceptate, Sodium Gluconate, Sodium Glycereth-1 Polyphosphate, Sodium Hexametaphosphate, Sodium Metaphosphate, Sodium Metasilicate, Sodium Phytate, Sodium Polydimethylglycinophenolsulfonate, Sodium Trimetaphosphate, TEA-EDTA, TEA-Polyphosphate, Tetrahydroxyethyl Ethylenediamine, Tetrahydroxypropyl Ethylenediamine, Tetrapotassium Etidronate, Tetrapotassium Pyrophosphate, Tetrasodium EDTA, Tetrasodium Etidronate, Tetrasodium Pyrophosphate, Tripotassium EDTA, Trisodium Dicarboxymethyl Alaninate, Trisodium EDTA, Trisodium HEDTA, Trisodium NTA and Trisodium Phosphate.

Agents according to the invention may furthermore contain alkalis. The bases used in agents according to the invention are preferably those from the group of alkali metal and alkaline earth metal hydroxides and carbonates, in particular sodium carbonate or sodium hydroxide. It is, however, also possible additionally to use ammonia and/or alkanolamines with up to 9 C atoms per molecule, preferably ethanolamines, in particular monoethanolamine.

Agents according to the invention may likewise contain preservatives. The substances stated in relation to the antimicrobial active ingredients may essentially be used for this purpose.

According to the invention, the agents may furthermore contain bleaching agents. Suitable bleaching agents comprise peroxides, peracids and/or perborates; hydrogen peroxide is particularly preferred. Sodium hypochlorite, on the other hand, is less suitable in cleaning agents with an acidic formulation due to the release of toxic chlorine gas vapors, but may be used in alkaline cleaning agents. Under certain circumstances, a bleaching activator may be present in addition to the bleaching agent.

The agent according to the invention may also contain enzymes, preferably proteases, lipases, amylases, hydrolases and/or cellulases. They may be added to the agent in any form established in the prior art. In the case of agents in liquid or gel form, this in particular includes solutions of the enzymes, advantageously as concentrated as possible, with a low water content and/or combined with stabilizers. Alternatively, the enzymes may be encapsulated, for example by spray drying or extruding the enzyme solution together with a preferably natural polymer or in the form of capsules, for example those in which the enzymes are enclosed as a solidified gel or in those of the core-shell type, in which an enzyme-containing core is coated with a protective layer which is impermeable to water, air and/or chemicals. Further active ingredients, for example stabilizers, emulsifiers, pigments, bleaching agents or dyes may additionally be applied in superimposed layers. Such capsules are applied in accordance with per se known methods, for example by agitated or rolling granulation or in fluidized bed processes. Advantageously, such granules are low-dusting, for example due to the application of a polymeric film former, and stable in storage thanks to the coating.

Agents containing enzymes may furthermore contain enzyme stabilizers in order to protect an enzyme present in an agent according to the invention from damage, such as for example inactivation, denaturation or disintegration, for instance due to physical influences, oxidation or proteolytic cleavage. Depending in each case on the enzyme used, suitable enzyme stabilizers are in particular: benzamidine hydrochloride, borax, boric acids, boronic acids or the salts or esters thereof, above all derivatives with aromatic groups, for instance substituted phenylboronic acids or the salts or esters thereof; peptide aldehydes (oligopeptides with a reduced C terminus), aminoalcohols such as mono-, di-, triethanol- and -propanolamine and mixtures thereof, aliphatic carboxylic acids up to C12, such as succinic acid, other dicarboxylic acids or salts of the stated acids; end group-terminated fatty acid amide alkoxylates; lower aliphatic alcohols and especially polyols, for example glycerol, ethylene glycol, propylene glycol or sorbitol; and reducing agents and antioxidants such as sodium sulfite and reducing sugars. Further suitable stabilizers are known from the prior art. Combinations of stabilizers are preferably used, for example the combination of polyols, boric acid and/or borax, the combination of boric acid or borate, reducing salts and succinic acid or other dicarboxylic acids or the combination of boric acid or borate with polyols or polyamino compounds and with reducing salts.

The agent according to the invention may finally contain one or more fragrances and/or one or more dyes as further ingredients. Dyes which may be used are both water-soluble and oil-soluble dyes, it being necessary on the one hand to ensure compatibility with further constituents, for example bleaching agents, and, on the other hand, that the dye used should not have a substantive action towards the surfaces, in particular towards WC ceramics, even in the event of an extended period of action. Selection of a suitable fragrance is likewise limited only by possible interactions with the other components of the cleaning agent.

The agent according to the invention may be produced in a manner conventional in the art by suitably mixing the components present in the agent with one another.

Agents according to the invention, which preferably assume the form of cleaning agents, are used in treating hard surfaces, in particular of ceramic sanitary ware. On the one hand, they may be used for providing a dirt-repellent finish on hard surfaces and for reducing resoiling of these surfaces, and, on the other hand, they permit more rapid and thorough cleaning of soiled surfaces.

In a preferred embodiment of the invention, agents according to the invention serve for the improved removal of fecal soiling and/or biofilms from the surfaces of flush toilets and/or for reducing renewed soiling of such surfaces with fecal soiling and/or biofilms. To this end, the agent is spread extensively over the surface and either rinsed off after a period of action of preferably 1 to 10 minutes or alternatively left to dry. Once the surface has been treated in this manner, fecal soiling is easier to remove, often without the assistance of mechanical aids, such as for instance a WC brush. Any dried on cleaning agent residues may additionally be rinsed away more easily.

Exemplary Embodiments

Three acidic WC cleaning agents Invention 1 to Invention 3 containing different proportions of one of the active ingredients used according to the invention were formulated as examples of thickened formulations. In contrast, a comparison formulation, Comparison 1, contained none of this active ingredient.

| Composition [wt. %] | Invention 1 | Invention 2 | Invention 3 | Comparison 1 |
|---|---|---|---|---|
| Active ingredient | 1 | 3 | 10 | 0 |
| C12 fatty alcohol ethoxylate + 7 EO | 3 | 3 | 3 | 3 |
| Octyl sulfate | 2 | 2 | 2 | 2 |
| KELTROL ASX-T (xanthan gum) | 0.3 | 0.3 | 0.3 | 0.3 |
| Citric acid | 5 | 5 | 5 | 5 |
| Blue dye | 0.1 | 0.1 | 0.1 | 0.1 |
| Ethanol | 3 | 3 | 3 | 3 |
| Perfume | 0.2 | 0.2 | 0.2 | 0.2 |
| Water | ad 100 | ad 100 | ad 100 | ad 100 |

Testing of cleaning performance with regard to fecal soiling and of rinsability were carried out with these formulations. A conventional commercial V&B type toilet was here in each case firstly thoroughly cleaned with the assistance of a toilet brush and ATA scouring cream, rinsed and left to dry.

Cleaning performance was tested by then applying one of the toilet cleaner formulations according to the invention, Invention 1-Invention 3, or the comparison formulation, Comparison 1, spreading it extensively over the surface, leaving it to act for 5 min and rinsing it off. Artificial fecal soiling (a mixture of bacterial biomass, fiber from plant cell wall material, glycerol and an aqueous solution, corresponding to patent DE 103 57 232 B3) was then applied, left to dry for 30 minutes and rinsed off. While 80% of the fecal soiling was still present after using the comparison formulation not according to the invention, Comparison 1, in the case of surfaces cleaned with the agents according to the invention, Invention 1-Invention 3, more than half of the fecal soiling could be removed with just one flush, while 100% of the soiling was removed after the second flush.

Rinsability was tested, after the above-described preliminary cleaning, by applying one of the toilet cleaner formulations according to the invention, Invention 1-Invention 3, or the comparison formulation, Comparison 1, spreading it extensively over the surface and leaving it to act for three hours. Thereafter, an extensive blue film on the interior wall of the toilet was observed for all the formulations. Once the toilet had been flushed, in the case of the cleaning product not according to the invention, Comparison 1, 90% of the original area was still covered with a visible blue film of cleaner formulation, while no visible film was any longer present when the formulations according to the invention, Invention 1, Invention 2 and Invention 3, were used.

Three coating solutions, Invention 4 to Invention 6, which likewise contained the polymer used according to the invention, and a comparison solution, Comparison 2, were also produced as examples of unthickened formulations.

| Composition [wt. %] | Invention 4 | Invention 5 | Invention 6 | Comparison 2 |
|---|---|---|---|---|
| Active ingredient | 2 | 5 | 5 | 0 |
| Lauryl ether sulfate + | 3 | 3 | — | 3 |

-continued

| Composition [wt. %] | Invention 4 | Invention 5 | Invention 6 | Comparison 2 |
|---|---|---|---|---|
| 2EO | | | | |
| $C_{8-10}$ alkylpolyglycoside | — | — | 3 | — |
| PEG, MW 40,000 | 1 | — | — | — |
| Citric acid | 0.5 | 0.5 | 0.5 | 0.5 |
| Ethanol | 8 | 8 | 8 | 8 |
| Perfume | 0.05 | 0.05 | 0.05 | 0.05 |
| Water | ad 100 | ad 100 | ad 100 | ad 100 |

Testing of cleaning performance with regard to fecal soiling and of rinsability was also carried out with these coating solutions. A conventional commercial V&B type toilet was here again firstly thoroughly cleaned with the assistance of a toilet brush and ATA scouring cream, rinsed and left to dry. One of the toilet cleaner formulations according to the invention, Invention 4-Invention 6, or the comparison formulation, Comparison 2, was then applied, spread extensively over the surface and left to dry. Artificial fecal soiling (a mixture of bacterial biomass, fiber from plant cell wall material, glycerol and an aqueous solution, corresponding to patent DE 103 57 232 B3) was then applied, left to dry for 30 minutes and rinsed off. While 95% of the fecal soiling was still present after using the comparison formulation not according to the invention, Comparison 2, in the case of surfaces cleaned with the agents according to the invention, Invention 4, Invention 5 and Invention 6, no fecal soiling could any longer be detected.

What is claimed is:

1. A method of treating a hard surface, the method comprising contacting the hard surface with an agent comprising at least one polycarbonate-, polyurethane- and/or polyurea-polyorganosiloxane compound and at least one surfactant by spreading the agent extensively over the hard surface and rinsing off the agent from the hard surface after a period of action of 1 to 10 minutes, wherein the at least one polycarbonate-, polyurethane- and/or polyurea-polyorganosiloxane compound contains at least one structural element of Formula (I):

$$-Y-A-(C{=}O)-A- \quad (I),$$

each A being independently selected from S, O or $NR^1$,

Y is a di- or polyvalent, straight-chain, cyclic or branched, saturated, unsaturated or aromatic, substituted or unsubstituted hydrocarbon residue with up to 1000 carbon atoms (not including the carbon atoms of an optionally present polyorganosiloxane unit), which may contain one or more groups selected from —O—, —(CO)—, —NH—, —$NR^2$—, —($N^+R^2R^3$)— or a polyorganosiloxane unit with 2 to 1000 silicon atoms, $R^1$ being hydrogen or a straight-chain, cyclic or branched, saturated, unsaturated or aromatic hydrocarbon residue with up to 40 carbon atoms, which may contain one or more groups selected from —O—, —(CO)—, —NH— or —$NR^2$—, $R^2$ being a straight-chain, cyclic or branched, saturated, unsaturated or aromatic hydrocarbon residue with up to 40 carbon atoms, which may contain one or more groups selected from —O—, —(CO)— or —NH, $R^3$ being a straight-chain, cyclic or branched, saturated, unsaturated or aromatic hydrocarbon residue with up to 100 carbon atoms, which may contain one or more groups selected from —O—, —(CO)—or —NH—, or being a divalent residue which forms a cyclic structure within the residue Y, or one or both of the residues A adjacent to Y possibly forming a nitrogenous heterocyclic residue with the residue Y located between them, and in the entire compound all the residues A or Y or $R^1$ or $R^2$ or $R^3$ stated in Formula (I) not necessarily being identical, providing that, in the entire compound, at least one of the residues Y comprises a polyorganosiloxane unit with 2 to 1000 silicon atoms, and/or an acid addition compound and/or a salt thereof.

2. The method as claimed in claim 1, wherein the polyorganosiloxane unit present in the polycarbonate-, polyurethane- and/or polyurea-polyorganosiloxane compound has the structure —$(R^4{}_2SIO)^p$-$(SIR^4{}_2)$- in which $R^4$ is a straight-chain, cyclic or branched, saturated, unsaturated or aromatic hydrocarbon residue with up to 20 carbon atoms, and p is 1 to 999.

3. The method as claimed in claim 2, wherein the polycarbonate-, polyurethane- and/or polyurea-polyorganosiloxane compound contains at least two polyorganosiloxane units.

4. The method as claimed in claim 1, wherein, in the polycarbonate-, polyurethane- and/or polyurea-polyorganosiloxane compound, at least one of the Y units according to the structural element of Formula (I) comprises a grouping —$NR^2$- and/or at least one of the Y units according to the structural element of Formula (I) comprises a grouping —($N^+R^2R^3$)-.

5. The method as claimed in claim 1, wherein oligoethoxy and/or oligopropoxy groups are present in at least one of the units Y, $R^1$, $R^2$ and/or $R^3$ according to the structural element of Formula (I), the oligoethoxy and/or oligopropoxy groups having degrees of oligomerization in the range from 2 to 60.

6. The method as claimed in claim 1, wherein oligoethyleneimine groups are present in at least one of the units Y, $R^1$, $R^2$ and/or $R^3$ according to the structural element of Formula (I), the oligoethyleneimine groups having degrees of oligomerization in the range from 10 to 150,000.

7. The method as claimed in claim 1, wherein a polycarbonate-, polyurethane- and/or polyurea-polyorganosiloxane compound which contains at least one structural element of Formula (II) or Formula (III):

$$-A-Y-A-(CO)-O-Z-(CHOH)-Z-O-(CO)- \quad (II),$$

$$-A-Y-A-(CO)-O-(CHCH_2OH)-Z-O-(CO)- \quad (III),$$

in which A and Y have the meanings stated for Formula (I) and Z is selected from divalent, straight-chain, cyclic or branched, saturated or unsaturated, optionally substituted hydrocarbon residues with 1 to 12 carbon atoms, is used.

8. The method as claimed in claim 1, wherein the hard surface is a ceramic hard surface.

9. The method as claimed in claim 1, wherein the hard surface being treated is, subsequent to the rinsing off of the agent, soiled with fecal soiling and/or a biofilm.

10. The method as claimed in claim 1, wherein the at least one surfactant is selected from the group consisting of anionic surfactants, nonionic surfactants, and mixtures thereof.

11. The method as claimed in claim 1, wherein contacting proceeds at a temperature of 5 to 50° C.

* * * * *

UNITED STATES PATENT AND TRADEMARK OFFICE

CERTIFICATE OF CORRECTION

PATENT NO. : 8,202,372 B2
APPLICATION NO. : 12/572609
DATED : June 19, 2012
INVENTOR(S) : Nadine Warkotsch et al.

It is certified that error appears in the above-identified patent and that said Letters Patent is hereby corrected as shown below:

On the Title Page under item (30) "Foreign Application Priority Date"

"10 2007 016 389" should read --10 2007 016 389.6--

"10 2007 023 871" should read --10 2007 023 871.3--

"10 2007 038 452" should read --10 2007 038 452.3--

Col. 16, Claim 2, line 15, the formula "$-(R^4{}_2SIO)^p-(SIR^4{}_2)-$" should read -- $-(R^4{}_2SiO)_p-(SiR^4{}_2)-$ --

Signed and Sealed this
Sixteenth Day of October, 2012

David J. Kappos

David J. Kappos
*Director of the United States Patent and Trademark Office*